US006022257A

United States Patent [19]

Saita et al.

[11] Patent Number: 6,022,257

[45] Date of Patent: Feb. 8, 2000

[54] METHOD OF CORRECTING GRILL HEIGHT SPACING OF A CATHODE-RAY TUBE

[75] Inventors: Koji Saita; Tozaburo Nishimura, both of Kanagawa, Japan

[73] Assignee: Sony Corporation, Japan

[21] Appl. No.: 09/165,339

[22] Filed: Oct. 2, 1998

[30] Foreign Application Priority Data

Oct. 6, 1997 [JP] Japan ..... 9-272845

[51] Int. Cl.[7] ..... H01J 9/42

[52] U.S. Cl. ..... 445/30; 445/3 A

[58] Field of Search ..... 445/30, 3 A

[56] References Cited

U.S. PATENT DOCUMENTS 4,267,624 5/1981 Augsburger ..... 445/3 A 4,979,920 12/1990 Nierenberg ..... 445/3 A

*Primary Examiner*—Kenneth J. Ramsey

*Attorney, Agent, or Firm*—Rader, Fishman & Grauer; Ronald P. Kananen

[57] ABSTRACT

A correcting method to correct a distance between an inner surface of a panel and a color selection mechanism of a cathode-ray tube is disclosed in which a female type machining electrode (21) having a concave portion (21*a*) same in shape as a panel pin (15) supporting the color selection mechanism is used, a center axis (22) of panel pin (15) and a center axis (23) of female type machining electrode (21) are made eccentric, and one surface of panel pin 15 is shaved by electric spark machining between the female type machining electrode (21) and the panel pin (15) in accordance with an correcting amount of the distance to thereby correct the distance with high precision.

7 Claims, 6 Drawing Sheets

METHOD OF CORRECTING GRILL HEIGHT SPACING OF A CATHODE-RAY TUBE

BACKGROUND OF THE INVENTION

1. Field of the Invention

The present invention relates to a correcting method when manufacturing a cathode-ray tube. In more detail, the present invention relates to a correcting method for controlling the distance between the inner surface of the panel of a cathode-ray tube and its color selection mechanism, namely a so-called grill height, with high precision.

2. Description of the Related Art

In a color cathode-ray tube used in a television receiver, a computer display device or the like, a color selection mechanism called as an aperture grill or a shadow mask is located in an opposing relation to a color phosphor screen on an inner surface of a panel. The distance between the panel inner surface and the color selection mechanism or so-called grill height GH greatly influences the landing of an electron beam on a phosphor layer, the landing clearance between a center electron beam and side electron beams, a light intensity distribution due to diffraction phenomenon, e.g., a Fresnel diffraction of an electron beam in an electron beam passing aperture of the color selection mechanism upon forming a phosphor layer and so on. Therefore, as the color cathode-ray tube becomes more highly definite, the grill height GH is required to be high in precision.

The precision of the grill height GH is affected most by an embedding error when a panel pin, i.e., a metal pin, for supporting the color selection mechanism is embedded in the panel and an attaching error when a support spring is attached to the color selection mechanism. Up to now, for the panel pin embedding error, there is established a technique, referred to a marige spring welding method, which corrects the embedding error upon welding the support spring. However, according to this method, it is difficult to suppress the precision of grill height to less than ±0.15 mm and hence there is a limit to make the color phosphor screen, the color selection mechanism or the like with a fine pitch.

Also, as to the grill height GH correction, in the prior art there was no means to correct the grill height GH after the panel and the color selection mechanism were completed.

SUMMARY OF THE INVENTION

In view of the above aspect, the present invention is to provide a correcting method upon manufacturing a cathode-ray tube which improves the precision of a distance between the panel inner surface and the color selection mechanism of the cathode-ray tube, i.e., the grill height GH, and can make the same with an ultra-fine pitch.

According to an aspect of the present invention, there is proposed a correcting method when manufacturing a cathode-ray tube in which a female-type machining electrode having substantially the same shape as a panel pin supporting a color selection mechanism is used, the female-type machining electrode is made eccentric in accordance with a correcting amount of the distance between the panel inner surface and the color selection mechanism, and one surface of the panel pin is shaved or cut by electric spark machining.

When one surface of the panel pin is shaved by the electric spark machining in accordance with the correcting amount of the distance between the panel inner surface and the color selection mechanism, the distance between the panel inner surface and the color selection mechanism can be adjusted finely, and hence the precision of the distance between the panel inner surface and the color selection mechanism can be made high.

DESCRIPTION OF THE PREFERRED EMBODIMENT

A correcting method when manufacturing a cathode-ray tube according to the present invention is a correcting method to correct the distance between a panel inner surface of a cathode-ray tube and its color selection mechanism which employs a female-type machining electrode having substantially the same shape as that of a panel pin supporting the color selection mechanism and in which, in accordance with a correcting amount of the above-mentioned distance, the center axis of the panel pin and the center axis of the female type machining electrode are made eccentric, and one surface of the panel pin is shaved or cut by the electric spark machining of the female type machining electrode.

Now, an embodiment of the present invention will be described with reference to the accompanying drawings.

FIGS. 1 to 4 show the structure of a color selection mechanism or a color selection mechanism called as an aperture grill and a panel supporting the color selection mechanism within the same of a cathode-ray tube to which the present invention is applied.

Figure 4:
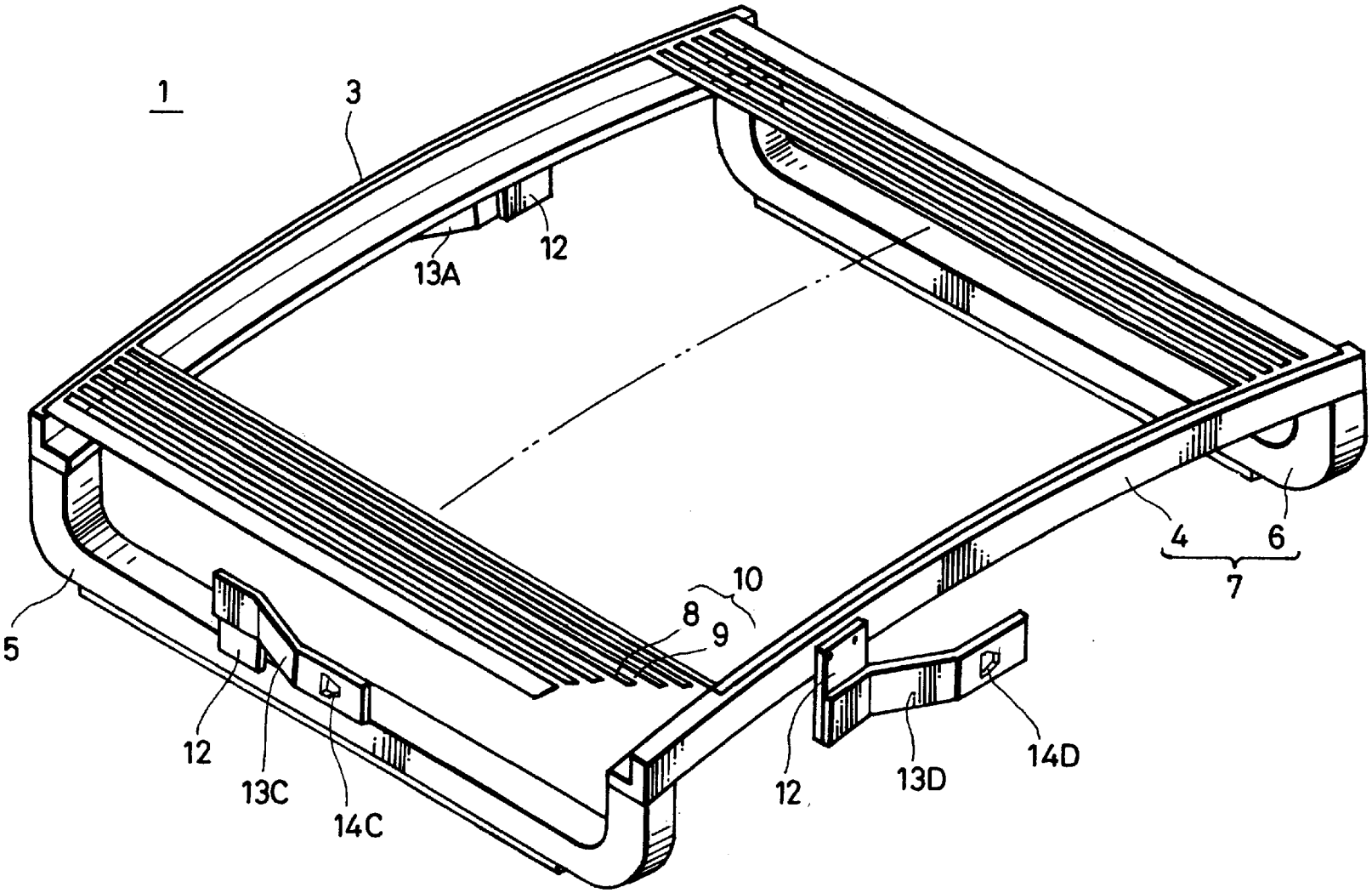
FIG. 4 is a perspective view showing a color selection mechanism to which the present invention is applied.

As shown in FIG. 4, a color selection mechanism 1 comprises a metal frame 7 having a frame shape which is formed of a pair of opposing support members 3 and 4 and a pair of elastic force-giving members 5 and 6 stretched between the respective end portions of both the support members 3 and 4, respectively. A mask member having a number of electron beam passing apertures 8 of slit shape arranged along one direction, specifically a horizontal direction of a picture screen or a color selection electrode thin plate 10 is stretched between the support members 3 and 4 of metal frame 7. The color selection electrode thin plate 10 is made of a metal thin plate which is formed of a member of grid elements 9 arranged in the above-mentioned one direction at a predetermined pitch and in which the electron beam passing aperture 8 long in the vertical direction of the screen is formed between the adjacent grid elements 9. The grid elements 9 are stretched by the elastic force giving members 5 and 6 between the support members 3 and 4 with a predetermined tension.

To the outside of the frame 7, a spring holder 12 is welded at three or four positions, at four positions of both the support members 3, 4 and both the elastic force giving members 5, 6 in this example. To the respective spring holders 12, support springs 13 (13A, 13B, 13C, 13D) are welded. At tip ends of the support springs 13 (13A, 13B, 13C, 13D) formed are pin bores 14 (14A, 14B, 14C, 14D) which are to engage with panel pins provided on the panel side, respectively. Each pin bore 14 is formed to be such a shape that each vertex of a triangle is cut away.

Figure 1:
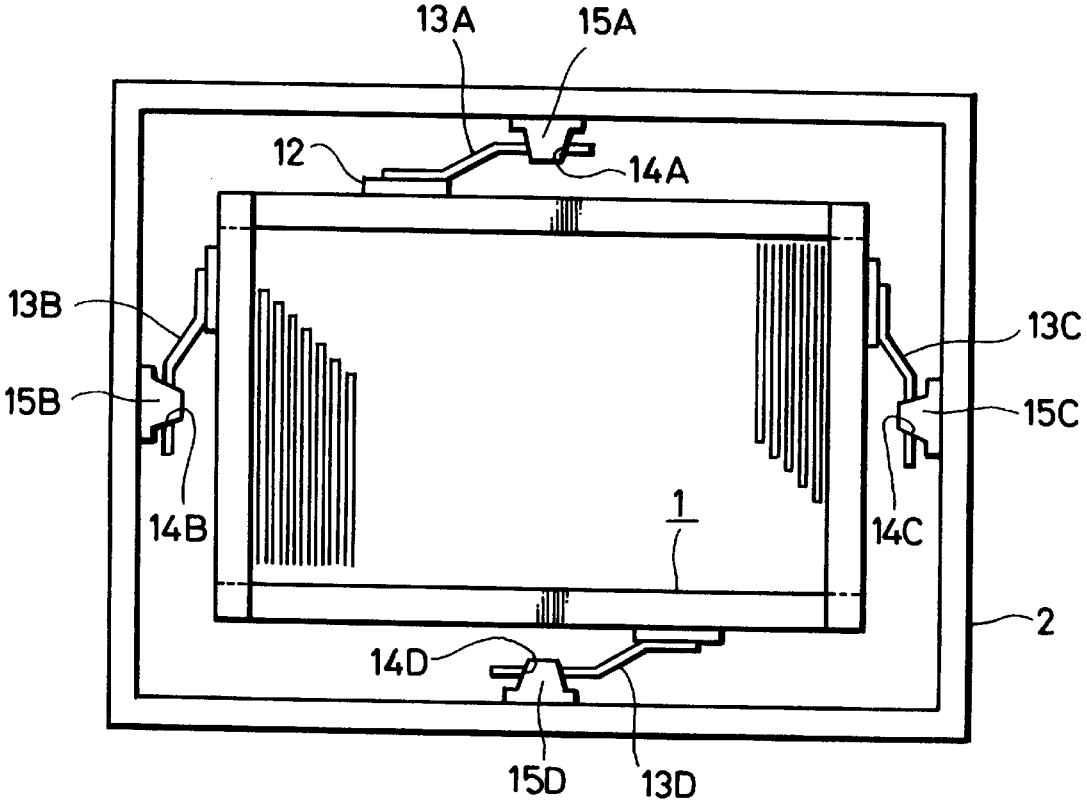
FIG. 1 is a rear view of a state in which a color selection mechanism is attached to the inside of a panel.
Figure 2:
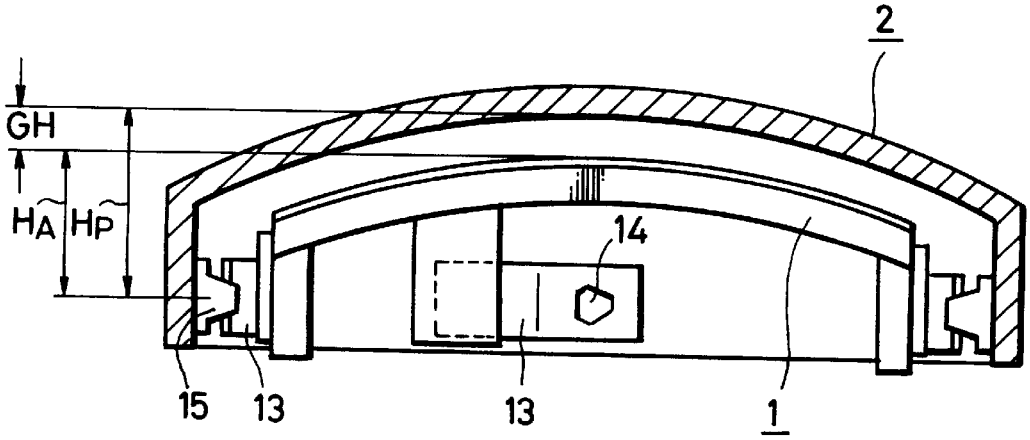
FIG. 2 is a cross-sectional view of FIG. 1.

As shown in FIGS. 1 and 2, on the inner side of a skirt portion of a panel 2, panel pins (or metal pins) 15 (15A, 15B, 15C, 15D), which are engageable with the pin bores 14 (14A, 14B, 14C, 14D) of support springs 13 (13A, 13B, 13C, 13D) respectively, are buried or embedded. Each panel pin 15 has such a shape that its portion engaged with each pin bore 14 is a frustum (see FIG. 3).

The color selection mechanism 1 is attached to the panel 2 by such a manner that each base portion of the support springs 13 (13A, 13B, 13C, 13D) is welded to each of the spring holders 12 for a grill height GH (see FIG. 2) between the surface of the color selection mechanism 1 and the inner surface of panel 2 to be within a standard value over all the surfaces thereof, and the pin bores 14 (14A, 14B, 14C, 14D) of the support springs 13(13A, 13B, 13C, 13D) are engaged with the panel pins (15A, 15B, 15C, 15D), respectively, whereby the color selection mechanism 1 is supported within the panel 2.

Figure 3:
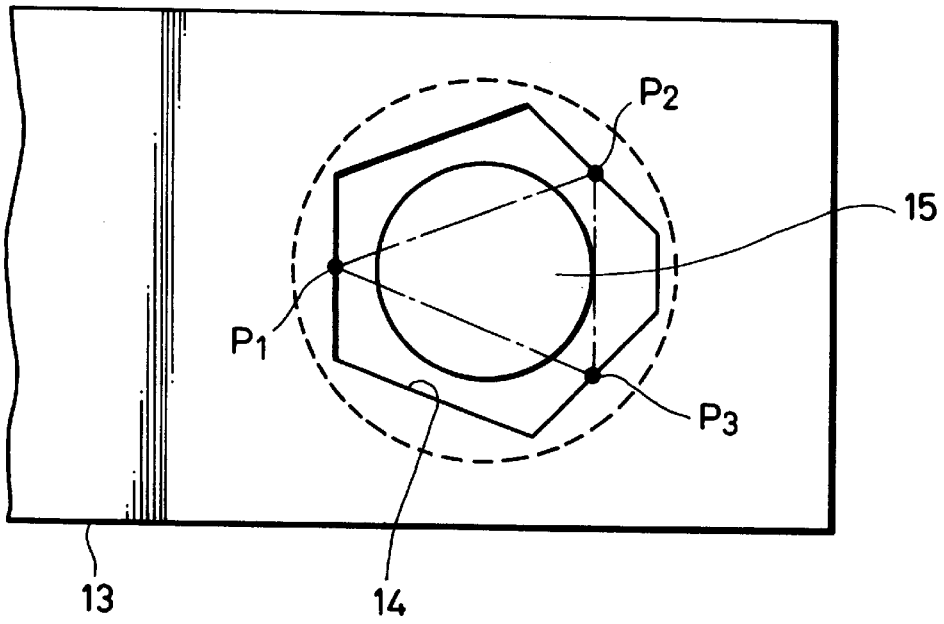
FIG. 3 is a plan view showing a main portion of an engaging portion of a panel pin to a support spring.

As shown in FIG. 3, the panel pin 15 is engaged with the pin bore 14 in such a manner that three sides of the pin bore 14 are in contact with the panel pin 15 of frustum at three points $P_1$, $P_2$, $P_3$.

Figure 5:
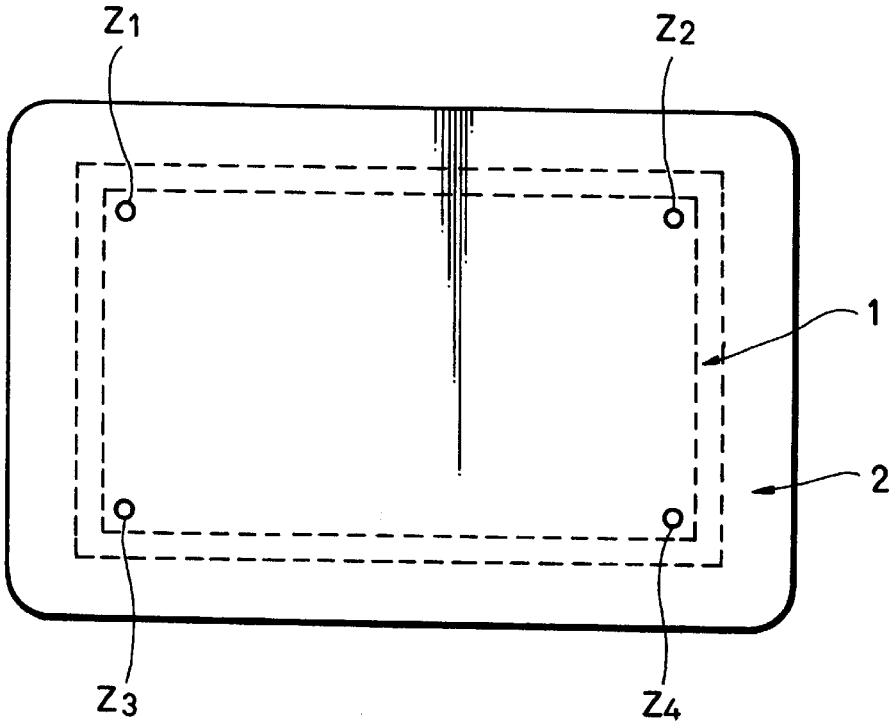
FIG. 5 is a schematic diagram showing a measuring point of a distance between the panel and the color selection mechanism.

A measuring point of the grill height GH is four points , $Z_1$, $Z_2$, $Z_3$, $Z_4$, corresponding to portions near four corners of the panel 2 and the color selection mechanism 1 in this example, as shown in FIG. 5.

As methods for measuring the grill height GH, there is such a method shown in FIG. 2 in which, for example, a distance $H_P$ from a reference position to the inner surface of panel 2 and a distance $H_A$ from the reference position to the surface of the color selection mechanism 1 are measured and then a difference therebetween or $GH=H_P-H_A$ is calculated. Also a method is provided in which the grill height GH is directly measured in such a state that the color selection mechanism 1 is assembled into the panel 1 or the like.

The method for correcting the grill height according to the present invention is such that the grill height GH, under the condition that the color selection mechanism 1 is supported and assembled in the panel 2, is measured at each of the measuring points $Z_1$ to $Z_4$, and based on the measured data, an amount corresponding to plane shifting of color selection mechanism 1 relative to the inner surface of panel 2 among errors of the grill height GH from a designed value (see FIG. 8) is corrected (namely,finely adjusted) by shaving or machining the panel pin 15.

The panel pin 15 is shaved or machined by electric spark machining.

Figure 6A:
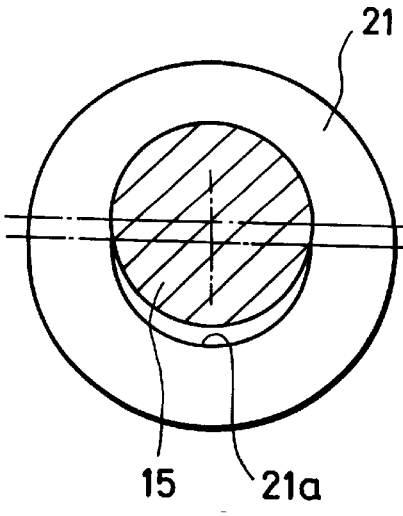
FIGS. 6A and 6B are diagrams used to explain an electric spark machining for a panel pin concerning the present invention.
Figure 6B:
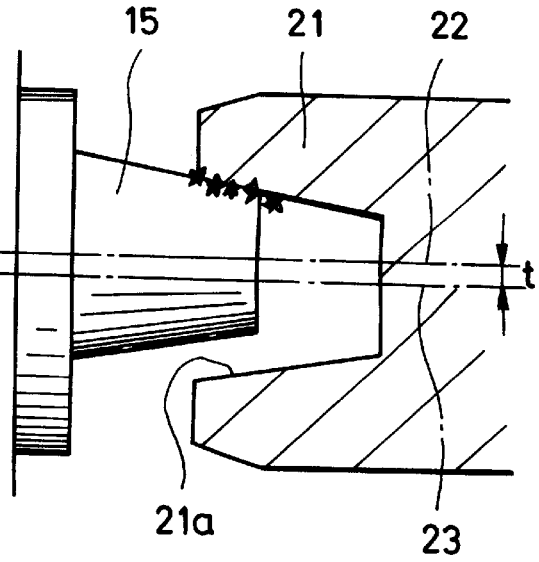

That is, as shown in FIGS. 6A and 6B, a female type machining electrode 21 having a concave portion 21*a* same in shape as the frustum of panel pin 15 is prepared.

Upon electric spark machining of panel pin 15, a center axis 22 of panel pin 15 and a center axis 23 of female type machining electrode 21 are relatively made eccentric in the correcting direction of grill height GH in response to a correcting amount of grill height GH as shown in FIGS. 6A and 6B. In other words, the axes 22 and 23 are relatively made eccentric by an electric spark machining amount t. Under that state, while a predetermined voltage is applied across the panel pin 15 and the female type machining electrode 21 with the side of panel pin 15 being grounded, the female type machining electrode 21 is moved such that its concave portion 21*a* is inserted with the panel pin 15. Thus, one surface of the upper and lower surfaces of panel pin 15, which is in contact with the female type machining electrode 21, in FIG. 6B the upper the surface is shaved or cut by the electric spark machining but the opposite surface is not subjected to the electric spark machining.

Figure 7A:
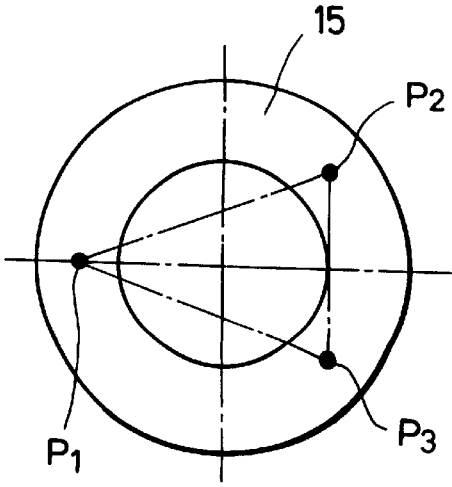
FIG. 7A is a diagram used to explain an engaging state of the panel pin to the support spring before the electric spark machining.

Under the state that the color selection mechanism 1 is assembled in the panel 2 at first, as shown in FIG. 7A, the center of panel pin 15 with the shape of frustum and the center of pin bore 14 formed in the support spring 13, the panel pin 15 being engaged with the pin bore 14, are coincident each other. When the female type machining electrode 21 with the concave portion 21*a* of frustrum is moved relative to the panel pin 15 of frustum and the electric spark machining is effected on the panel pin 15, as shown in FIG. 7B, the center axis of frustum is shifted from reference numeral 22 to reference numeral 23 up and down.

Figure 7B:
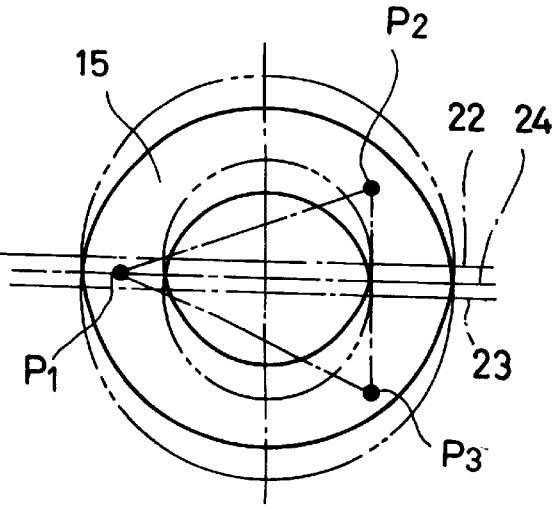
FIG. 7B is a diagram used to explain an engaging state of the panel pin to the support spring after the electric spark machining is carried out for the panel pin.

When the panel pin 15 subjected to the electric spark machining is engaged with the pin bore 14 of the support spring 13, as shown in FIG. 7B, an engaging center 24 of support spring 13 is shifted by the shifted amount of the center axis of frustum, namely the amount corresponding to one half of electric spark machining amount t.

Accordingly, of errors of the grill height GH from the designated value, any one of the plane shift amounts of color selection mechanism 1 relative to the panel 2 can be corrected by cutting off the upper or lower side surfaces of four panel pins 15 (15A, 15B, 15C, 15D) in response to the correcting amount through the electric spark machining.

Figure 8:
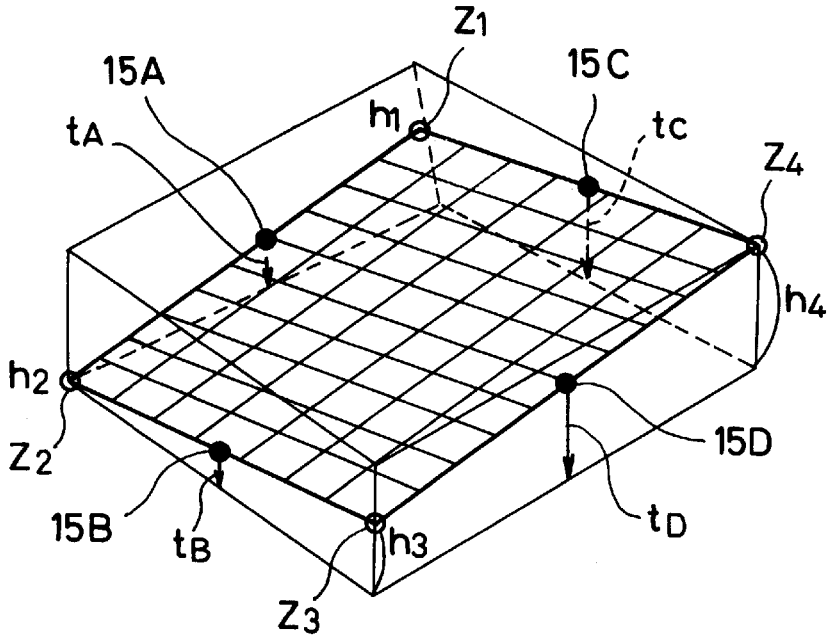
FIG. 8 is a schematic view showing a shifted amount of the distance between the panel inner surface and the color selection mechanism.

For example. as shown in FIG. 8, if it is assumed that the positions of panel pins 15A to 15D correspond to the centers of respective sides of frame 7 of color selection mechanism 1 and shifted amounts of grill height GH from the designed value at respective measuring points $Z_1$, $Z_2$, $Z_3$ and $Z_4$ are $h_1$, $h_2$,$h_3$ and $h_4$, correcting amounts a, b, c and d of panel pins 15A, 15B, 15C and 15D are expressed as follows;

$a=1/2\ (h_1+h_2)$ $b=1/2\ (h_2+h_3)$ $c=1/2\ (h_1+h_4)$ $d=1/2\ (h_3+h4)$

Figure 9:
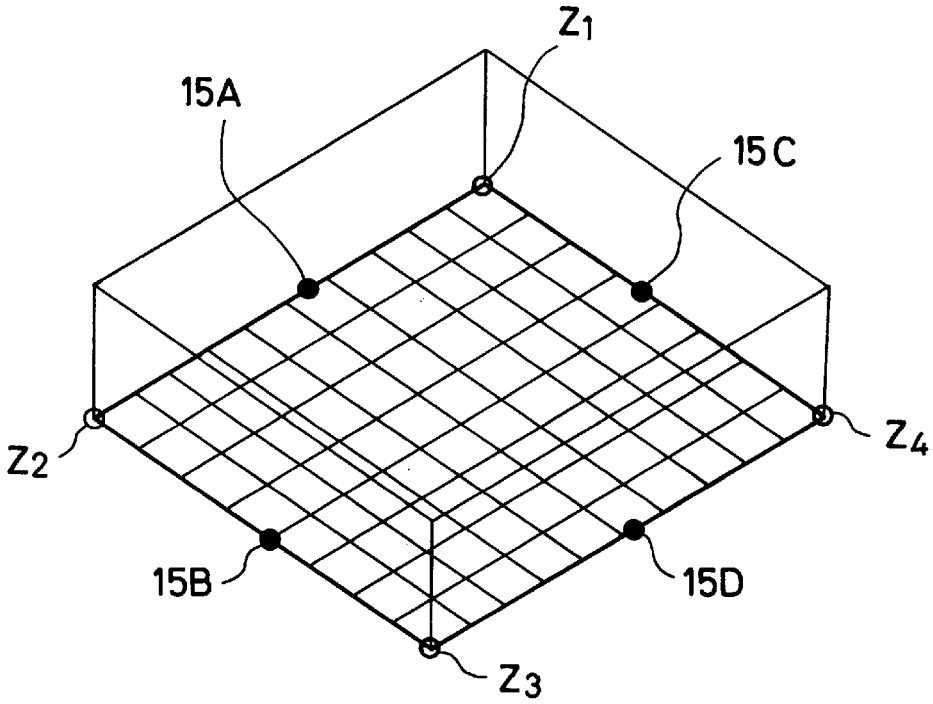
FIG. 9 is a schematic diagram showing such a state that the shifted amount of the distance between the panel inner surface and the color selection mechanism is corrected by a method according to the present invention.

Accordingly, machining amounts $t_A$, $t_B$, $t_c$ and $t_D$ of panel pins 15A to 15D become as follows;

$t_A=2\times a=h_1+h_2$ $t_B=2\times b=h_2+h_3$ $t_C=2\times c=h_1+h_4$ $t_D=2\times d=h_3+h_4$ If one surface of each of the respective panel pins 15A to 15D are cut away by the electric spark machining based on the machining amounts $t_A$ to $t_D$, the shift corresponding to the plane shift amount is corrected as shown in FIG. 9.

Figure 10:
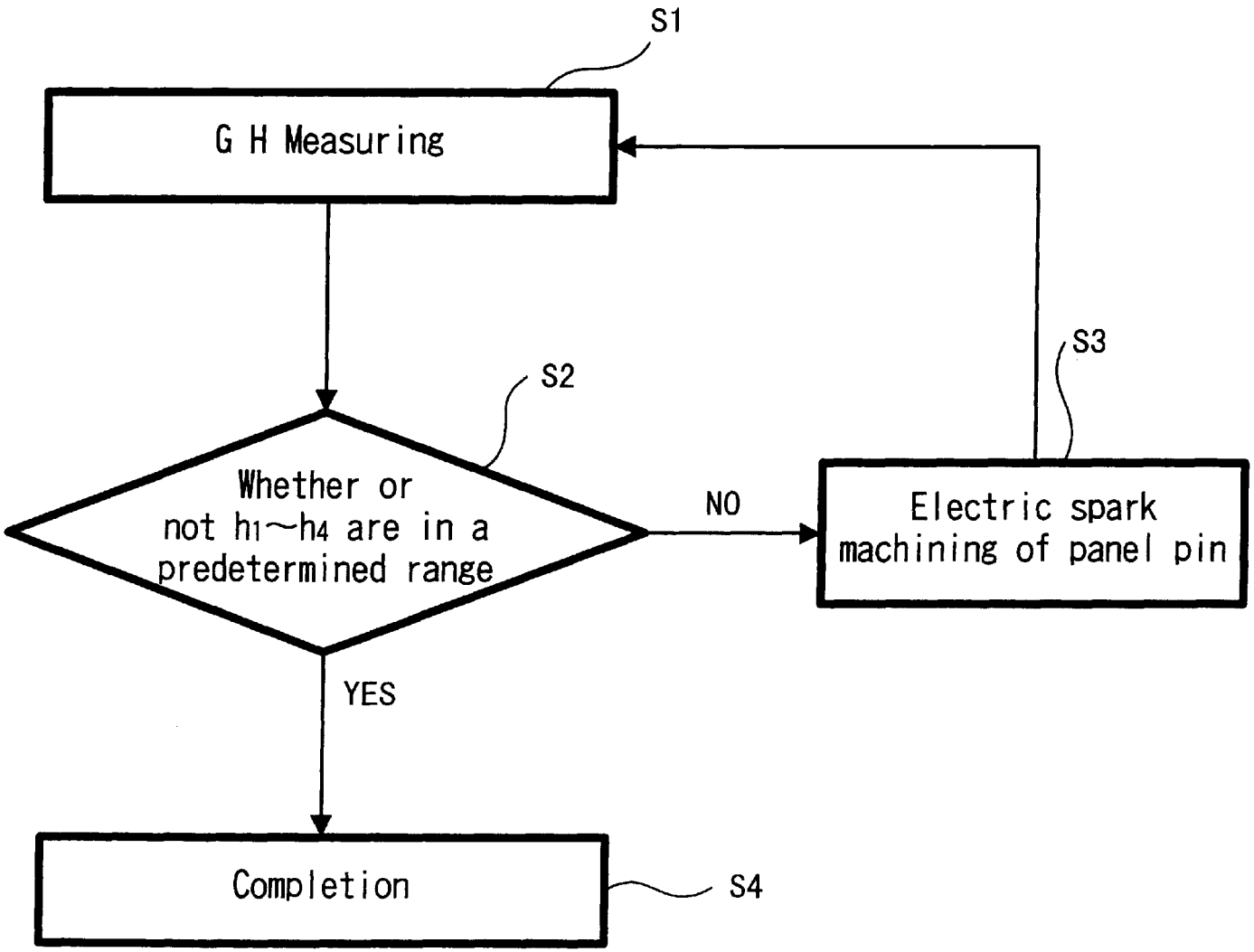
FIG. 10 is a flow chart of the correcting method upon manufacturing a cathode-ray tube according to the present invention.

FIG. 10 shows a flow chart of the correcting method according to the present invention.

The grill height GH at each of measuring points $Z_1$ to $Z_4$ under the state that the color selection mechanism 1 is assembled into the panel 2 is measured and the shifting amounts $h_1$, $h_2$, $h_3$, $h_4$ thereof from the designed value are obtained (step $S_1$).

It is judged whether or not the shifting amounts $h_1$ to $h_4$ exist within the range of a predetermined tolerance (for example, ±50$\mu$) (step $S_2$).

When the shifting amounts $h_1$ to $h_4$ are not within the range of predetermined tolerance, the color selection mechanism 1 is disassembled from the panel 2. Then, the electric spark machining is applied to the panel pin 15 in accordance with that shifting amount and the grill height is adjusted finely (step S3).

After the fine adjustment is achieved and the color selection mechanism 1 is assembled into the panel 2, the grill height GH is measured again in step $S_1$ and the shifting amounts $h_1$ to $h_4$ are obtained. In step $S_2$, if the shifting amounts $h_1$ to $h_4$ are not within the range of predetermined tolerance, the electric spark machining is applied to the panel pin 15 again (step $S_3$). If, on the contrary, the shifting amounts $h_1$ to $h_4$ are within the range of predetermined tolerance, the assembly is estimated as a good product and process is completed.

According to the correcting method of the present invention, the precision of the grill height GH can be controlled to be less than a conventional tolerance ±0.15 mm, for example, less than one half of conventional tolerance. Therefore, the ultra-fine pitch of a cathode-ray tube (for example, the pitch of the electron beam passing aperture 8 of color selection mechanism 1 is less than 0.20 mm) can be realized.

While the above-mentioned example of the present invention is applied to a cathode-ray tube using an aperture grill as the color selection mechanism, it is needless to say that the present invention is not limited thereto but the present invention can be applied to other cathode-ray tubes such as a cathode-ray tube using a shadow mask or the like.

According to the correcting method of the present invention, the distance between the panel inner surface and the color selection mechanism or grill height GH can be controlled with high precision, and also the above-mentioned distance GH can be corrected after the completion of panel and color selection mechanism.

Therefore, a color cathode-ray tube, which is formed with ultra-high definition (with a so-called ultra-fine pitch), can be realized.

Having described a preferred embodiment of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claim.

What is claimed is:

1. A correcting method when manufacturing a cathode-ray tube to correct a distance between a panel inner surface and a color selection mechanism of the cathode-ray tube, comprising the steps of:

using a female type machining electrode having substantially the same shape as a panel pin supporting the color selection mechanism;

arranging a center axis of said panel pin and a center axis of said female type machining electrode in eccentricity in accordance with a correcting amount of said distance; and cutting one surface of said panel pin by an electric spark machining through said female type machining electrode.

2. The method as set forth in claim 1, wherein a plurality of panel pins support said color selection mechanism, said cutting step being repeated sequentially for more than one of said plurality of panel pins.

3. The method as set forth in claim 2, wherein positions of said plurality of panel pins A to D correspond to the centers of respective sides of a frame of said color selection mechanism wherein an amount of grill height is determined from a predetermined value at respective measuring points, and wherein the machining amounts are respectively the sums of the predetermined heights.

4. A correcting method when manufacturing a cathode-ray tube to correct a distance between a panel inner surface and a color selection mechanism of the cathode-ray tube, comprising the steps of:

measuring a grill height at each of a plurality of measuring points and determining shifting amounts thereof from the designed value;

determining whether the respective shifting amounts are within a range of a predetermined tolerance;

disassembling said panel inner surface from said color selection mechanism of the cathode ray tube when said respective shifting amounts are outside of said predetermined tolerance;

adjusting said shifting amounts from among said respective shifting amounts by electric spark machining; and repeating, if necessary, said steps of determining and adjusting.

5. The method as set forth in claim 4 wherein said predetermined range is +/−50 microns.

6. The method as set forth in claim 4 wherein the step of adjusting is carried out using a female type machining electrode having substantially the same shape as said plurality of panel pins when a center axis of said panel pins and a center axis of said female type machining electrode are positioned eccentrically in accordance with a correcting amount of said distance.

7. The method as set forth in claim 6 wherein said shape is frustum.

* * * * *